US005701045A

United States Patent [19]

Yokozawa et al.

[11] Patent Number: 5,701,045

[45] Date of Patent: Dec. 23, 1997

[54] AXIAL FLOW AIR FAN HAVING LATERAL SUCTION AND DISCHARGE PORTS FOR COOLING ELECTRONIC COMPONENTS

[75] Inventors: Shinjiro Yokozawa, Tokyo; Nobumasa Kodama, Ueda; Toshiki Ogawara, Toubumachi, all of Japan

[73] Assignee: Sanyo Denki Co., Ltd., Tokyo, Japan

[21] Appl. No.: 672,376

[22] Filed: May 29, 1996

[30] Foreign Application Priority Data

May 31, 1995 [JP] Japan ..... 7-134394

[51] Int. Cl.[6] ..... H02K 9/00; H02K 9/06

[52] U.S. Cl. ..... 310/62; 310/58; 310/59; 310/61; 310/62; 310/63

[58] Field of Search ..... 310/59, 61, 62, 310/63, 52, 58

[56] References Cited

U.S. PATENT DOCUMENTS

| | | | |
|---|---|---|---|
| 4,164,690 | 8/1979 | Muller et al. | 318/254 |
| 4,904,891 | 2/1990 | Baker et al. | 310/62 |
| 4,959,571 | 9/1990 | Yasumoto et al. | 310/67 R |
| 5,296,769 | 3/1994 | Havens et al. | 310/90 |
| 5,379,999 | 1/1995 | Barzideh et al. | 271/264 |

FOREIGN PATENT DOCUMENTS

| | | | |
|---|---|---|---|
| 231940 | 9/1990 | Japan | 310/62 |
| 231941 | 9/1990 | Japan | 310/62 |

*Primary Examiner*—Clayton E. LaBalle

*Assistant Examiner*—Elvin G. Enad

*Attorney, Agent, or Firm*—Pearne, Gordon, McCoy & Granger LLP

[57] ABSTRACT

An air fan capable of increasing the amount of air fed in a radial direction thereof. An impeller which includes a plurality of blades for sucking air from one side in an axial direction of a revolving shaft of a motor and guiding sucked air mainly toward the other side in the axial direction is mounted on a rotor of the motor. A casing includes a peripheral wall arranged so as to define a cavity therein in which the motor and impeller are received. The peripheral wall is provided at a portion thereof in proximity to an end thereof on the one side with a lateral suction port which permits air to be suckedly introduced therethrough into the cavity in a radial direction of the revolving shaft. Also, the peripheral wall of the casing is provided at a portion thereof in proximity to an end thereof on the other side with a lateral discharge port which permits air suckedly introduced into the cavity to be discharged therethrough in the radial direction. The lateral suction port and lateral discharge port are arranged so as not to be aligned with each other in the axial direction.

13 Claims, 3 Drawing Sheets

AXIAL FLOW AIR FAN HAVING LATERAL SUCTION AND DISCHARGE PORTS FOR COOLING ELECTRONIC COMPONENTS

BACKGROUND OF THE INVENTION

This invention relates to an air fan, and more particularly to an air fan adapted to be arranged in a receiving housing of an electronic appliance to cool an electronic component.

Japanese Patent Application Laid-Open Publications Nos. 231940/1990 (2-231940) and 231941/1990 (2-231941) each disclose an air fan constructed so as to guide air in a radial direction thereof perpendicular to an axial direction thereof by means of an axial fan means. Such an air fan is generally called a radial fan in the art. An axial fan includes an impeller securely mounted on a revolving shaft of a motor. The impeller is provided with a plurality of blades and constructed so as to suck air on one of both sides defined in an axial direction of the revolving shaft of the motor and guide it toward the other side. Also, the impeller is arranged in a cylindrical cavity which is defined by a peripheral wall of the casing. The axial fan has characteristics capable of increasing the amount of air fed while keeping a pressure at a reduced level. The radial fan described above was developed utilizing such advantageous characteristics of the axial fan. Thus, the radial fan is reduced in thickness or depth and exhibits characteristics of increasing the amount of air fed as compared with a cross-flow fan or a cirrocco fan and reducing noise as compared with a cirrocco fan.

The conventional radial fan described above is so constructed that the cavity in which the impeller is received is closed at one end thereof with a closing wall and provided with a lateral discharge port, which is formed by substantially removing a part of a peripheral wall of the casing. The lateral discharge port is provided so as to thoroughly extend from one end of the cavity to the other end thereof, so that the blades of the impeller each are fully exposed from the lateral discharge port of the casing when it faces the port.

The inventors made such a radial fan as described above utilizing the axial fan and conducted an experiment on the radial fan thus made. As a result, it was found that the radial fan causes the amount of air discharged from the lateral discharge port and blown against a component to be cooled to be less than expected.

Also, when the conventional radial fan is arranged in a receiving housing of an electronic appliance decreased in thickness or depth, it causes the amount of air fed to be excessively decreased or rendered substantially zero.

SUMMARY OF THE INVENTION

The present invention has been made in view of the foregoing disadvantage of the prior art.

Accordingly, it is an object of the present invention to provide an air fan which is capable of significantly increasing the amount of air fed.

It is another object of the present invention to provide an air fan which is capable of effectively feeding a required amount of air even when it is arranged in a receiving housing of an electronic appliance decreased in thickness or depth.

It is a further object of the present invention to provide an air fan for cooling an electronic component which is capable of effectively feeding a required amount of air even when it is arranged in a receiving housing of an electronic appliance decreased in thickness or depth.

It is a still further object of the present invention to provide an electronic appliance which is capable of effectively cooling an electronic component generating heat, even when a space in a receiving casing of an electronic appliance in which the electronic component cooling apparatus is arranged is reduced.

In accordance with the present invention, an air fan is provided which includes a motor including a rotor and a stator, an impeller securely mounted on the rotor and including a plurality of blades for sucking air from one side (suction side) in an axial direction of a revolving shaft of the motor and guiding sucked air mainly toward the other side (discharge side) in the axial direction, and a casing including a peripheral wall arranged so as to define a cavity therein in which the motor and impeller are received.

In the air fan of the present invention generally constructed as described above, the peripheral wall of the casing is provided at a portion thereof in proximity to an end thereof on the above-described one side (suction side) with at least one lateral suction port which permits air to be suckedly introduced therethrough into the cavity in a radial direction of the revolving shaft. The peripheral wall may be constructed in any way so long as it provides the cavity which permits the impeller to be rotated therein. For example, the peripheral wall may include a cylindrical wall arranged so as to surround the impeller. The cylindrical wall may be provided with a mounting section on which the air fan is mounted also, the cylindrical wall may be provided on an outside thereof with a frame. In this instance, the cylindrical frame may be so constructed that a part thereof constitutes a part of the frame. Further, the lateral suction port is arranged so as to face at least in a radial direction of the revolving shaft. It may face the other side or discharge side.

The peripheral wall of the casing is provided at a portion thereof in proximity to an end thereof on the other side (discharge side) with at least one lateral discharge port which permits the air suckedly introduced into the cavity to be discharged therethrough in the radial direction of the revolving shaft. The lateral discharge port is formed so as to prevent occurrence of air circulation which causes a large amount of air discharged from the lateral discharge port to be suckedly returned through an open end of the cavity on the one side or suction side or the lateral suction port into the cavity immediately after the discharge. The air circulation will be more detailedly described hereinafter. The lateral discharge port may be arranged so as to face at least in the radial direction of the revolving shaft. It is not necessarily required that the port faces the other side or discharge side.

In the present invention, the lateral suction port and lateral discharge port are formed so as to prevent air circulation which causes a large part of air discharged through the lateral discharge port to be suckedly returned through the lateral suction port to the cavity immediately after the discharge. More specifically, the lateral suction port and lateral discharge port are arranged so as not to be aligned with each other or be in a row in the axial direction.

Formation of the lateral suction port at the peripheral wall of the casing permits air to be suckedly introduced into the cavity not only on the one side or suction side but in the radial direction, resulting in the air fan more effectively cooling an electronic component. However, it was found that formation of the lateral suction port at the peripheral wall of the casing fails to feed a sufficient amount of air when an opposite member such as a circuit board or the like which is arranged on an inner surface of the receiving housing or received in the receiving housing is arranged on an end surface of the casing on the one side or suction side in a manner to substantially face the cavity. More particularly, it was found that a decrease in distance between an end surface of the air fan on the suction side or an open end of the cavity on the suction side and the opposite member to a certain level or more causes the air fan to fail in feeding of air. Such situation leads to a problem that design of an electronic appliance having the air fan of the present invention incorporated therein is rendered substantially difficult.

Thus, the casing is preferably formed so that a space between the end surface of the casing on the one side or suction side and the blades may establish a suction pressure sufficient to permit a sufficient amount of air to be suckedly introduced through the lateral suction port into the cavity when the opposite member is arranged on the end surface of the casing in a manner to substantially face the cavity. This may be realized by increasing a length of the peripheral wall of the casing in the axial direction or providing any suitable spacer means on the end surface of the peripheral wall of the casing on the suction side.

In order to increase cooling efficiency of the air fan or the amount of air discharged through the lateral discharge port, it is essential to prevent "air circulation" which causes a large part of air discharged from the discharge port to be suckedly returned through the open end of the cavity on the one side to the cavity. The inventors made various experiments and as a result, it was found that the reasons why the conventional fan described above fails in satisfactory feeding of air are that the discharge port is arranged so as to extend over one end of the cavity to the other end thereof, resulting in each of the blades of the impeller being exposed through the discharge port when it faces the port during rotation of the impeller. Such full exposure of the blade through the discharge port leads to the above-described air circulation. The air circulation causes suction of fresh ambient air into the cavity to be decreased in an amount corresponding to the amount of air returned to the cavity due to the air circulation. Ideally, it is preferable that the lateral suction port and lateral discharge port are provided so as to fully prevent the air circulation. In this connection, an object of the present invention can be effectively accomplished by reducing the air circulation.

In a preferred embodiment of the present invention, the blades of the impeller are arranged so as to guide the sucked air in the radial direction to the utmost. Even the impeller for the axial fan permits air to be fed in the radial direction by centrifugal force due to rotation of the impeller. In this instance, the blades are preferably designed so as to permit air to be fed as much as possible in the radial direction by the centrifugal force. The impeller thus designed substantially increases the amount of air fed as compared with the conventional impeller for the axial fan.

In a preferred embodiment of the present invention, the peripheral wall of the casing may be formed of four side walls into a substantially rectangular outer configuration. In this instance, at least one of the side walls of the peripheral wall of the casing is provided with the above-described lateral suction port and at least one of the remaining side walls of the peripheral wall of the casing is provided with the above-described lateral discharge port, resulting in the air circulation being restrained. The lateral suction port is preferably provided at at least one side wall adjacent to the side wall provided with the lateral discharge port. The reason would be that a decrease in distance between the suction port and the discharge port while ensuring restraint of the air circulation reduces flow resistance of air to increase air feed efficiency of the air fan. Formation of the lateral suction port at each of the remaining side walls ensures that a sufficient amount of air is discharge through one lateral discharge port even when the open end of the cavity on the suction side is fully closed with the opposite member.

The air fan of the present invention may be arranged in the receiving housing of the electronic appliance in various manners. The electronic component cooling air fan is received in the receiving housing while permitting a space sufficient for establishing a suction pressure to be provided between the open end of the cavity on the one side or suction side and the opposite member facing the open end. The electronic component cooling air fan is arranged adjacent to and in juxtaposition to to one or more electronic components, to thereby ensure flowing of air directly against the electronic components or a heat sink provided with respect to the electronic components. In this instance, in order to maximize the amount of air discharged from the lateral discharge port, an open end of the cavity on the other side or discharge side is closed with the inner surface of the receiving housing or a circuit board arranged in the receiving housing. When other electronic components arranged on the circuit board are to be concurrently cooled, the electronic component cooling air fan is arranged so as to define a space between the air fan and the circuit board.

When the casing is so formed that a suction pressure enough to permit a sufficient amount of air to be suckedly introduced into the cavity is established in the space defined between the end surface of the casing on the one side and the blades of the impeller even when the opposite member is arranged on the end surface of the casing on the one side so as to substantially face the cavity, the electronic component cooling air fan may be so arranged that the open end of the cavity on the suction side is closed with the inner surface of the receiving housing or the circuit board.

Further, the electronic component cooling air fan may be fixed on the heat sink.

As described above, the air fan of the present invention is so constructed that the cavity in which the impeller is received is open on both sides thereof in the axial direction as in the conventional axial fan and the peripheral wall of the casing is formed with both lateral suction port and lateral discharge port in a manner not to be aligned with each other in the axial direction, to thereby prevent the air circulation. Such construction of the present invention permits a sufficient amount of air to be fed from the lateral discharge port in the axial direction. Also, it permits air to be fed in the axial direction as in the conventional axial fan.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an air fan according to the present invention will be described hereinafter with reference to the accompanying drawings.

Figure 1:
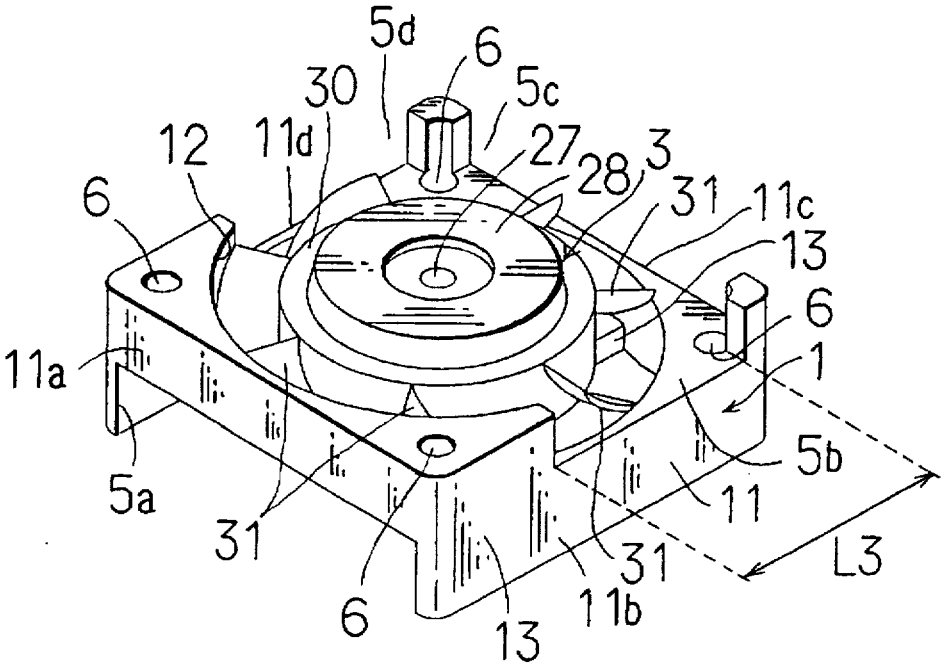
FIG. 1 is a perspective view showing an embodiment of an air fan according to the present invention.
Figure 2:
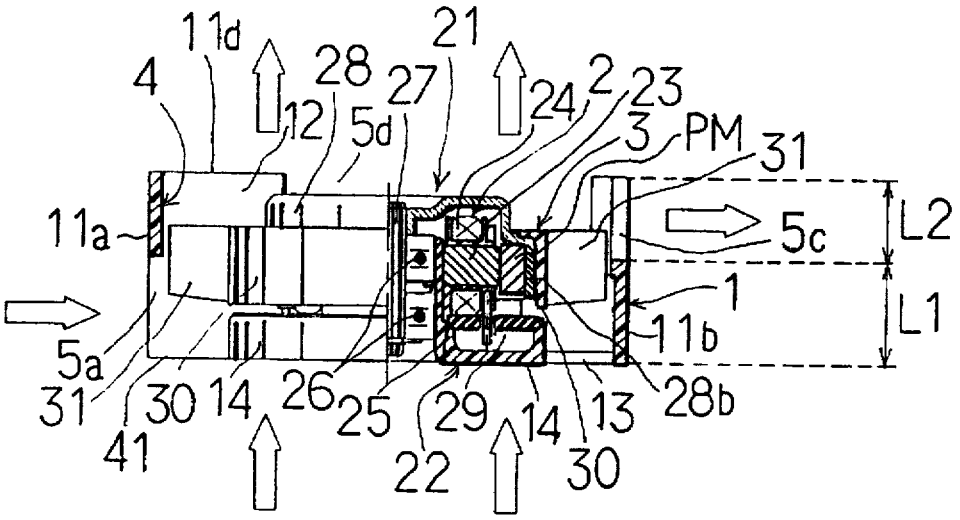
FIG. 2 is a sectional view of the air fan shown in FIG. 1.

Referring first to FIGS. 1 and 2, an embodiment of an air fan according to the present invention is illustrated. In FIG. 2, arrows indicate a direction of flow of air. In FIGS. 1 and 2, reference numeral 1 designates a casing which will be detailedly described hereinafter, and 2 is a motor including a rotor 21 and a stator 22. A two-phase DC brushless motor may be used as the motor 2. The stator 22 of the motor 2, as shown in FIG. 2, includes an iron core 23 and an exciting coil 24 wound on the core 23 and is mounted on a cylindrical boss section 14*a* provided on a motor housing 14 supported on the casing 1 through three webs 13 acting as a connection means. The webs 13 are arranged so as to be spaced from each other at angular intervals of 120 degrees. The webs 13 and motor housing 14 may be formed integrally with the casing 1. The boss section 14*a* has a bearing holder 25 fitted therein, in which a pair of bearings 26 are arranged in a manner to be spaced from each other at a predetermined interval. Reference numeral 27 designates a revolving shaft which is rotatably supported at one end thereof on the bearings 26 and fitted at the other end thereof in a hole formed at a bottom wall 28*a* of a cup-like member 28. The bearing holder 25 is mounted thereon with a circuit board 29 on which electronic components constituting a drive circuit are mounted. The cup-like member 28 also includes a peripheral wall 28*b*, which is mounted on an inner peripheral surface thereof with a plurality of magnetic poles each provided by a permanent magnet PM. The rotor 21 is constructed of a combination of the rotor 21, revolving shaft 27, cup-like member 28 and permanent magnets PM.

Reference numeral 3 designates an impeller which is securely mounted on the rotor 21 and includes a plurality of blades 31 arranged so as to permit air to be sucked from one side or suction side of an axial direction of the revolving shaft 27 of the motor 2 and then guided mainly toward the other side or discharge side of the axial direction. The impeller 3 also includes a ring section 30 fitted on the peripheral wall 28*b* of the cup-like member 28 of the rotor 21, on which the blades 31 are integrally provided. The blades 31 of the impeller 3 each are so configured and orientated that air sucked may be guided in a radial direction of the impeller 3 to the utmost.

Now, the casing 1 will be more detailedly described hereinafter. The casing 1 is integrally formed of synthetic resin such as polybutylene terephthalate or the like. The casing 1 is formed therein with a cylindrical cavity 4 in which the motor 2 and impeller 3 are received. For this purpose, casing 1 includes a peripheral wall 11 constructed of four side walls 11*a* to 11*d* arranged in a substantially rectangular manner in plan. Four such side walls 11*a* to 11*d* cooperate with each other to provide the cylindrical wall 12 which has the cavity 4 defined therein and a frame 13 defined on an outside thereof. In the illustrated embodiment, a part of the cylindrical wall 12 serves as a part of the frame 13.

The side wall 11*a* which is one of the four side walls 11*a* to 11*d* is formed at portion thereof in proximity to an end thereof on the suction side with an opening 5*a* constituting a lateral suction port through which air is suckedly introduced into the cavity 4 in the radial direction of the revolving shaft 27. The remaining side walls 11*b* to 11*d* are formed at a portion thereof in proximity to an end thereof on the discharge side with openings 5*b* to 5*d* each constituting a lateral discharge port through which air suckedly introduced from an open end 41 of the cavity 4 into the cavity is discharged in the radial direction of the revolving shaft 27.

In the illustrated embodiment, the opening or lateral discharge ports 5*b* to 5*d* are formed and dimensioned so as to prevent air circulation which causes a large part of air discharged from the lateral discharge ports or openings 5*b* to 5*d* to be suckedly returned to the cavity 4 from the the lateral suction port or opening 5*a* and the open end 41 of the cavity 4 immediately after the discharge, resulting in improving a cooling function of the air fan or increasing the amount of air discharged from the lateral discharge ports or openings 5*b* to 5*d*. More specifically, a length L1 of the side wall 11*a* which is a dimension thereof in the axial direction of the revolving shaft 27 is determined so as to prevent each of the blades 31 of the impeller 3 from being fully exposed through the lateral discharge ports or openings 5*b* to 5*d* at every time when the blade is rendered opposite to or faces the port during rotation of the impeller. The length L1 is determined depending on a size of the air fan and a capacity thereof. When the air fan has a size of 40 mm×40 mm×16 mm (thickness or depth) and is rotated at a speed of 5,000 rpm, the dimension L1 is preferably about 5 mm or more. Also, a length L2 of the lateral discharge ports 5*b* to 5*d* which is a dimension thereof in the axial direction of the revolving shaft 27 is preferably set so that a dimension of each of the blades 31 in the axial direction which is exposed therethrough is about 3 mm. When the openings 5*b* and 5*c* each are used as the lateral suction port as in an embodiment shown in FIGS. 3 and 4, the dimension L2 is required to be set at a limit value or more.

A width L3 of each of the openings 5*b* to 5*d* may be determined as desired. In the illustrated embodiment, the openings 5*b* and 5*d* are formed into the same width and the opening 5*c* is formed into a width larger than that of the openings 5*b* and 5*d*, to thereby minimize air circulation from the openingb 5*b* and 5*d* to the opening 5*a*. Alternatively, the openings 5*b* and 5*d* may be formed into the same size as the opening 5*c*. Such formation of the openings would likewise substantially prevent the air circulation because a direction of suction of air from the opening 5*a* and that of discharge of air from the openings 5*b* and 5*d* are perpendicular to each other. Thus, the openings 5*b* to 5*d* may be formed into the same size. Also, a size of the openings may be determined as desired depending on conditions under which the air fan is used while being arranged in the receiving housing of the electronic appliance. Thus, it is not limited as defined in the illustrated embodiment.

Likewise, a configuration of the opening or lateral suction port 5*a* and a dimension thereof may be determined so as to prevent the air circulation at the opening 5*a*.

In the illustrated embodiment, a configuration of the openings and a size thereof may be determined so that the casing 1 exhibits a satisfactory function also when the opening 5*a* acts as the lateral discharge port and the openings 5*b* to 5*d* act as the lateral suction ports, as in an embodiment of FIGS. 3 and 4 which will be described hereinafter.

When the air fan is so constructed that the opening 5*a* acts as the lateral suction port as described above, the motor housing 14 on which the stator 22 of the motor 2 is fixed permits a sufficient space to be provided between the blades 31 of the impeller 3 and the open end 41 of the cavity on the suction side. This, even when the open end of the cavity on the suction side is fully closed with the closing wall 12B, ensures that air is smoothly sucked from the lateral suction ports.

Figure 3:
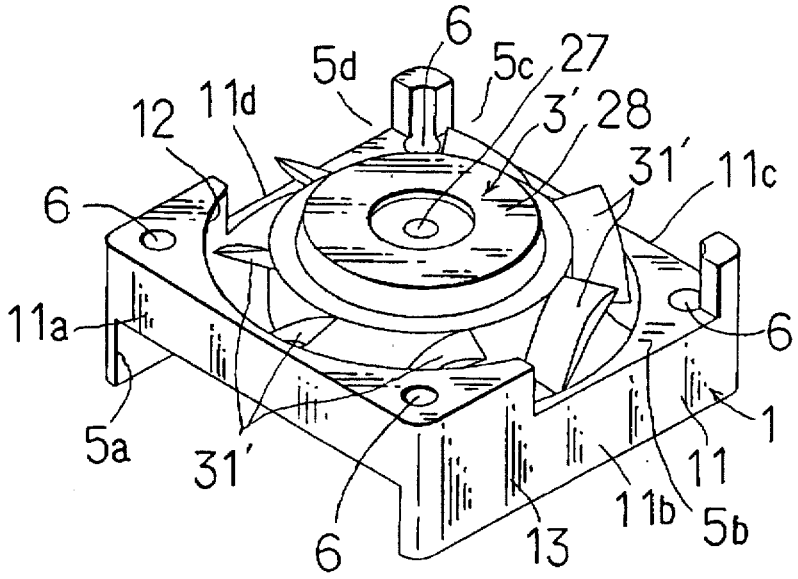
FIG. 3 is a perspective view showing another embodiment of an air fan according to the present invention.
Figure 4:
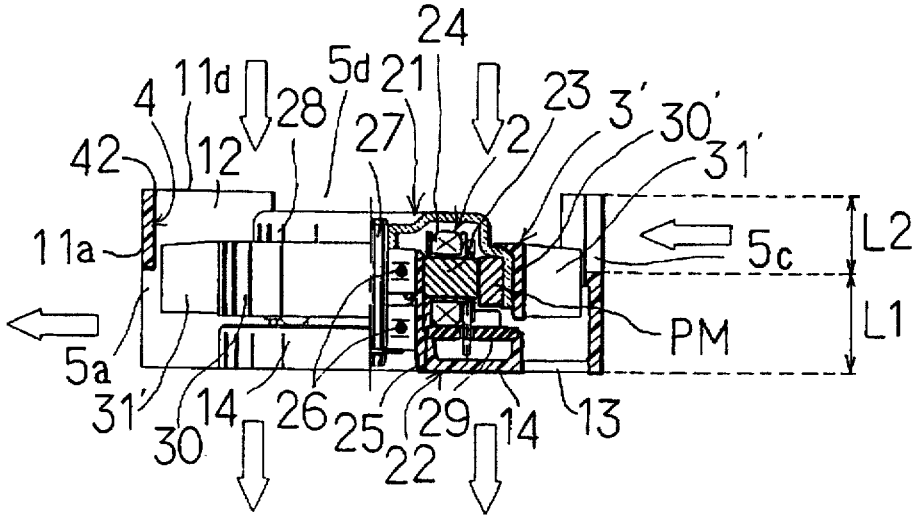
FIG. 4 is a sectional view of the air fan shown in FIG. 3.

Referring now to FIGS. 3 and 4, another embodiment of an air fan according to the present invention is illustrated. In an air fan of the illustrated embodiment, blades 31' of an impeller 3' are constructed in a manner different from those in the above-described embodiment. More particularly, in the illustrated embodiment, the blades 31' are formed so as to guide air in a direction opposite to that in the embodiment shown in FIGS. 1 and 2. Thus, in the illustrated embodiment, an opening 5*a* constitutes a lateral discharge port and openings 5*b* to 5*d* each constitute a lateral suction port. Also, this causes an open end 42 of a cavity is positionally opposite to that in the embodiment of FIGS. 1 and 2. The remaining part of the illustrated embodiment may be constructed in substantially the same manner as as the embodiment shown in FIGS. 1 and 2.

The illustrated embodiment is suitably arranged in a receiving housing of an electronic appliance such as, for example, a microcomputer which is reduced in depth or thickness, like the embodiment of FIGS. 1 and 2. A decrease in depth of the receiving housing necessarily causes a decrease in distance between an end surface of the air fan on one side or a suction side or an open end 41 of the cavity 4 on the suction side and an inner surface of the receiving housing or an opposite member such as a circuit board received in the receiving housing. An excessive decrease in distance causes the air fan to fail in feeding of air. An air fan is generally constructed so that rotation of blades leads to a reduction in pressure, to thereby cause air to flow from a high pressure region to a low pressure region. However, an excessive reduction in distance between the opposite member and the blades would render in separation between the high pressure region and the low pressure region hazy or indistinct, resulting in the air fan failing in feeding of air. In other words, the opposite member acts as a barrier between the low pressure region and the high pressure region (or a central portion of the impeller), to thereby block flowing of air. Thus, it will be noted that the distance is highly significant for feeding of air. It is hard for a user to decide or determine the distance. In this connection, in the illustrated embodiment, the lateral suction ports 5*b* to 5*d* ensures positive air feeding even when the open end 42 of the cavity 4 on the suction side is closed with the opposite member.

In the illustrated embodiment, a dimension L2 of a casing 1 is determined so as to ensure that a space defined between an end surface of of the casing 1 on the suction side and the blades establishes a suction pressure sufficient to permit a sufficient amount of air to be suckedly introduced through the lateral suction ports or openings 5*b* to 5*d* into the cavity 4, even when the opposite member is arranged on the end surface of the casing 1 on the suction side in a manner to substantially face the cavity 4. Thus, the dimension is sufficient to generate a pressure difference which permits air to flow in the space when the impeller 3' is rotated. Formation of the casing 1 into such a configuration permits a space required for establishing the suction pressure to be positively provided when the air fan of the illustrated embodiment is arranged in a receiving housing of any depth or thickness.

When the air fan is operated while keeping the open end of the cavity 4 on the suction side open, it is not required that the dimension L2 is determined so as to permit a pressure difference sufficient for flowing air to be generated in the space between a side end of the blades 31' on the suction side and the an open end 42 on the suction side.

Supposing that the amount of air fed in the axial direction by a conventional axial fan is 1, that in the radial direction by the air fan of the illustrated embodiment is as small as about 0.33. For comparison, the amount of air fed by a conventional cirrocco fan intended to feed air in the radial direction is about 0.2 and, in order to accomplish the same air feeding, the cirrocco fan requires electric power increased by 15% or more as compared with the air fan of the illustrated embodiment.

The inventors made an experiment of air feeding by means of the air fan of the illustrated embodiment while suitably mounting a plate on each of both ends of the casing 1 to close both ends and closing the openings 5*b* to 5*d*. As a result, it was found that the amount of air fed is decreased in order of (1) opening of all openings 5*b* to 5*d*, (2) opening of the openings 5*b* and 5*d* and closing of the opening 5*c*, (3) opening of one of the openings 5*b* and 5*d* and closing of the other opening, (4) opening of the opening 5*b* or 5*d* and closing of the other openings and (5) opening of the opening 5*c* and closing of the other openings.

The results indicate that the air fan of the illustrated embodiment permits the amount of air fed to be maximum. The embodiment shown in FIGS. 1 and 2 is decreased in the amount of air fed because of only one lateral suction port.

A receiving housing of a microcomputer of the notebook type which is commercially available tends to be further decreased in depth or thickness. Thus, it is estimated that it will be required to reduce a thickness of an air fan received in the receiving housing to a level as small as 20 mm or less. However, the conventional cross-flow fan or cirrocco fan substantially fails to provide a required amount of air when it is reduced in thickness to such a level. It will be noted that the air fan of the present invention effectively solves such a problem as encountered with the prior art.

Figure 5:
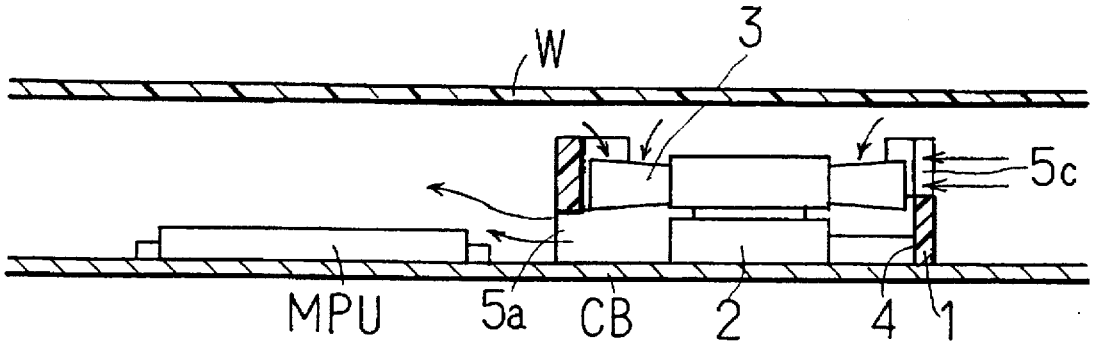
FIG. 5 is a schematic view of the air fan shown in FIG. 3 which is used as an air fan for cooling an electronic component or a DC brushless air fan for cooling an electronic component while being received in a receiving housing of an electronic appliance.

FIG. 5 schematically shows the air fan of FIGS. 3 and 4 which is used as an air fan for cooling a microprocessor or a DC brushless air fan for cooling the electronic component while being received in a receiving housing of a microcomputer of the notebook type which is an electronic appliance. In FIG. 5, reference character W designates a wall of a receiving housing of an electronic appliance and MPU is a microprocessor mounted directly on a circuit board CB. In the example, the air fan is mounted on the circuit board CB in a manner to be adjacent to the microprocessor MPU. Also, the open end of the cavity on the discharge side is closed with the circuit board CS. Further, the air fan is so arranged that the lateral discharge port or opening 5*a* faces the microprocessor MPU. Such arrangement of the air fan permits the microprocessor MPU to be directly cooled.

Figure 6:
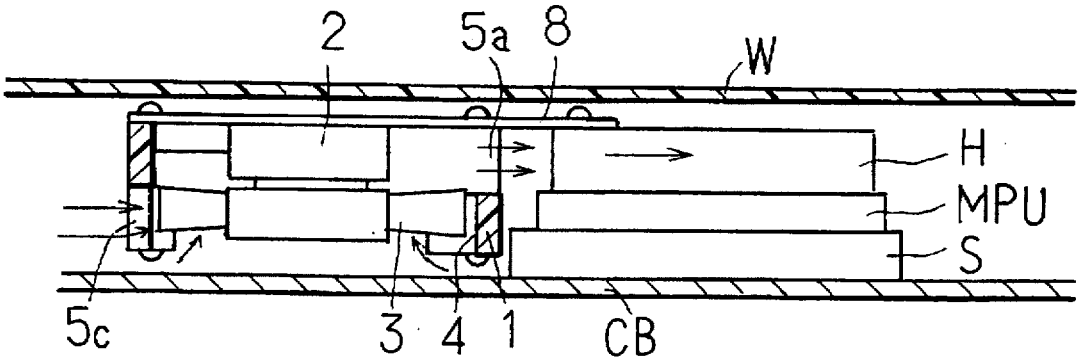
FIG. 6 is a schematic view showing the air fan of FIG. 3 securely mounted on a heat sink for cooling a microprocessor.

FIG. 6 shows another example of arrangement of the fan of FIGS. 3 and 4 on a heat sink H for cooling a microprocessor MPU, wherein the air fan is fixed on the heat sink H. In FIG. 6, reference character S designates a socket for mounting a microprocessor MPU. The air fan is screwed on a fitment 8 provided on the heat sink H through the mounting holes 6 of the casing 1. In the example as well, the air fan is arranged so that the lateral discharge port or opening 5*a* faces the heat sink H for cooling the microprocessor MPU. Such arrangement of the air fan likewise permits the microprocessor MPU to be cooled indirectly through the heat sink H directly cooled. It is a matter of course that the fitment 8 may be formed in a manner to be integral with the heat sink H.

In the example shown in each of FIGS. 5 and 6, the air fan is intended to feed air directly to the the electronic component. Alternatively, the air fan may be intended to discharge air in the receiving housing to an exterior thereof or introduce ambient air into the receiving housing.

As can be seen from the foregoing, the air fan of the present invention is so constructed that the lateral suction port and lateral discharge port are arranged so as to prevent air circulation which causes a large part of air discharged from the lateral discharge port to be suckedly returned through the lateral suction port to the cavity immediately after the discharge. Such construction ensures that the air fan of the present invention feeds air in an amount sufficient to cool an electronic component. Also, the air fan of the present invention effectively feeds air in the axial direction as well, like the conventional axial fun, resulting in a degree of freedom of applications of the air fan being significantly increased. Further, the air fan of the present invention permits air to be fed in the radial direction even when the open end of the cavity on the suction side is closed with the opposite member.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An air fan comprising:

a motor including a rotor and a stator;

an impeller securely mounted on said rotor and including a plurality of blades for sucking air from one side in an axial direction of a revolving shaft of said motor and guiding sucked air mainly toward the other side in said axial direction; and a casing including a peripheral wall arranged so as to define a cavity therein in which said motor and impeller are received;

said cavity being formed so as to be open on said both sides in said axial direction;

said peripheral wall of said casing being provided at one end thereof on said one side with at least one lateral suction port which permits air to be sucked therethrough into said cavity in a radial direction of said revolving shaft;

said peripheral wall of said casing being provided at the other end thereof on said the other side with at least one lateral discharge port which permits said air sucked into said cavity to be discharged therethrough in the radial direction of said revolving shaft;

said lateral suction port and lateral discharge port being arranged so as not to be aligned with each other in said axial direction.

2. An air fan as defined in claim 1, wherein said blades of said impeller are arranged so as to guide said sucked air toward said radial direction.

3. An air fan as defined in claim 1, wherein an end surface of said casing on said one side cooperates with said blades to define a space therebetween;

said space being formed so as to establish a suction pressure sufficient to permit a sufficient amount of air to be sucked through said lateral suction port into said cavity when an opposite member is arranged on said end surface of said casing on said one side so as to substantially face said cavity.

4. An air fan as defined in claim 1, wherein said lateral suction port and lateral discharge port are arranged so as to prevent air circulation which causes a large amount of air discharged from said lateral discharge port to be returned through said lateral suction port to said cavity immediately after the discharge.

5. An air fan as defined in claim 1, wherein said lateral discharge port is arranged so as to prevent air circulation which causes a large amount of air discharged from said lateral discharge port to be returned through an open end of said cavity on said one side to said cavity immediately after the discharge.

6. A DC brushless air fan comprising:

a DC brushless motor including a rotor and a stator;

an impeller securely mounted on said rotor and including a plurality of blades for sucking air from one side in an axial direction of a revolving shaft of said motor and guiding sucked air mainly toward the other side in said axial direction;

a casing including a peripheral wall arranged so as to define a cavity therein in which said motor and impeller are received;

said cavity being formed so as to be open on said both sides in said axial direction; and a connection means for connecting said stator of said motor and said casing to each other;

said peripheral wall being constructed of four side walls into a substantially rectangular outer configuration;

at least one of said side walls of said peripheral wall of said casing being provided at one end thereof on said the other side with at least one lateral discharge port which permits air sucked into said cavity to be discharged therethrough in a radial direction of said revolving shaft;

at least one of the remaining side walls of said peripheral wall of said casing being provided at the other end thereof on said one side with at least one lateral suction port which permits air to be introduced therethrough into said cavity in the radial direction of said revolving shaft.

7. A DC brushless air fan as defined in claim 6, wherein said suction port is provided at at least one side wall adjacent to said side wall provided with said lateral discharge port.

8. A DC brushless air fan as defined in claim 6, wherein said lateral suction port is provided at each of the side walls other than said side wall provided with said lateral discharge port.

9. An air fan for cooling an electronic component which is adapted to be received in a receiving housing of an electronic appliance to cool an electronic component received in the receiving housing, comprising:

a motor including a rotor and a stator;

an impeller securely mounted on said rotor and including a plurality of blades for sucking air from one side in an axial direction of a revolving shaft of said motor and guiding sucked air mainly toward the other side in said axial direction; and a casing including a peripheral wall arranged so as to define a cavity therein in which said motor and impeller are received;

said cavity being formed so as to be open on said both sides in said axial direction;

said peripheral wall of said casing being provided at one end thereof on said one side with at least one lateral suction port which permits air to be sucked therethrough into said cavity in a radial direction of said revolving shaft;

said peripheral wall of said casing being provided at the other end thereof on said other side with at least one lateral discharge port which permits said air sucked into said cavity to be discharged therethrough in the radial direction of said revolving shaft;

said lateral suction port and lateral discharge port being arranged so as to prevent air circulation which causes a large amount of air discharged from said lateral discharge port to be returned through said lateral suction port into said cavity immediately after the discharge.

10. An air fan for cooling an electronic component as defined in claim 9, wherein said casing is formed so as to ensure that a space defined between an end surface of of said casing on said one side and said blades establishes a suction pressure sufficient to permit a sufficient amount of air to be sucked through said lateral suction port into said cavity, when an opposite member is arranged on said end surface of said casing on said one side in a manner to substantially face said cavity.

11. An electronic appliance having an air fan for cooling an electronic component incorporated therein, wherein said air fan comprises a motor including a rotor and a stator, an impeller securely mounted on said rotor and including a plurality of blades for sucking air from one side in an axial direction of a revolving shaft of said motor and guiding sucked air mainly toward the other side in said axial direction, and a casing including a peripheral wall arranged so as to define a cavity therein in which said motor and impeller are received;

said cavity being formed so as to be open on said both sides in said axial direction;

said peripheral wall of said casing being provided at one end thereof on said one side with at least one lateral suction port which permits air to be sucked therethrough into said cavity in a radial direction of said revolving shaft;

said peripheral wall of said casing being provided at the other end thereof on said the other side with at least one lateral discharge port which permits said air sucked into said cavity to be discharged therethrough in the radial direction of said revolving shaft;

said lateral suction port and lateral discharge port being arranged so as to prevent air circulation which causes a large amount of air discharged from said lateral discharge port to be returned through said lateral suction port into said cavity immediately after the discharge;

said casing being formed so as to ensure that a space defined between an end surface of said casing on said one side and said blades establishes a suction pressure sufficient to permit a sufficient amount of air to be sucked through said lateral suction port into said cavity when an opposite member is arranged on said end surface of said casing on said one side in a manner to substantially face said cavity;

said air fan is juxtaposed to said electronic component while being adjacent to said electronic component; and said air fan is arranged so as to permit air discharged through said lateral discharge port to be directly blown against said electronic component or a heat sink arranged with respect to said electronic component.

12. An electronic appliance having an air fan for cooling an electronic component incorporated therein, comprising:

a receiving housing in which said air fan and electronic component are received;

said air fan including a motor which includes a rotor and a stator, an impeller securely mounted on said rotor and including a plurality of blades for sucking air from one side in an axial direction of a revolving shaft of said motor and guiding sucked air mainly toward the other side in said axial direction, and a casing including a peripheral wall arranged so as to define a cavity therein in which said motor and impeller are received;

said cavity being formed so as to be open on said both sides in said axial direction;

said peripheral wall of said casing being provided at one end thereof on said one side with at least one lateral suction port which permits air to be sucked therethrough into said cavity in a radial direction of said revolving shaft;

said peripheral wall of said casing being provided at the other end thereof on said the other side with at least one lateral discharge port which permits said air sucked into said cavity to be discharged therethrough in the radial direction of said revolving shaft;

said lateral suction port and lateral discharge port being arranged so as to prevent air circulation which causes a large amount of air discharged from said lateral discharge port to be returned through said lateral suction port into said cavity immediately after the discharge;

said casing being formed so as to ensure that a space defined between an end surface of said casing on said one side and said blades establishes a suction pressure sufficient to permit a sufficient amount of air to be sucked through said lateral suction port into said cavity when an opposite member is arranged on said end surface of said casing on said one side in a manner to substantially face said cavity;

said air fan being arranged in said receiving housing so that said casing is abutted against an inner surface of said receiving housing or a surface of a circuit board arranged in said receiving casing.

13. An electronic appliance having an air fan for cooling an electronic component incorporated therein, wherein said air fan comprises a motor including a rotor and a stator, an impeller securely mounted on said rotor and including a plurality of blades for sucking air from one side in an axial direction of a revolving shaft of said motor and guiding sucked air mainly toward the other side in said axial direction, and a casing including a peripheral wall arranged so as to define a cavity therein in which said motor and impeller are received;

said cavity being formed so as to be open on said both sides in said axial direction;

said peripheral wall of said casing being provided at the other end thereof on said the other side with at least one lateral discharge port which permits said air sucked into said cavity to be discharged therethrough in the radial direction of said revolving shaft;

said lateral suction port and lateral discharge port being arranged so as to prevent air circulation which causes a large amount of air discharged from said lateral discharge port to be returned through said lateral suction port into said cavity immediately after the discharge;

said casing being formed so as to ensure that a space defined between an end surface of said casing on said one side and said blades establishes a suction pressure sufficient to permit a sufficient amount of air to be introduced through said lateral suction port into said cavity when an opposite member is arranged on said end surface of said casing on said one side in a manner to substantially face said cavity; and said air fan is mounted on a heat sink.

* * * * *

UNITED STATES PATENT AND TRADEMARK OFFICE

CERTIFICATE OF CORRECTION

PATENT NO. : 5,701,045

DATED : December 23, 1997

INVENTOR(S) : Yokozawa et al.

It is certified that error appears in the above-indentified patent and that said Letters Patent is hereby corrected as shown below:

On the title page; In Section [75], the second and third inventors' cities are incorrect, delete "Veda" and insert --Nagano-ken--, also delete "Toubumachi" and insert --Nagano-Ken--.

Column 2, line 26, delete "mounted also" and insert --mounted. Also,--.

Column 3, line 61, after "provided" delete "at" (second occurrence).

Column 4, line 12, after "juxtaposition" delete "to" (second occurrence).

Column 6, line 37, delete "openingb" and insert --opening--.

In Claim 10, line 7, delete "of" (second occurrence).

Signed and Sealed this

Twenty-fifth Day of August, 1998

Bruce Lehman

*Attest:*

BRUCE LEHMAN

*Attesting Officer*

*Commissioner of Patents and Trademarks*